US006331151B2

(12) United States Patent
Calandro

(10) Patent No.: US 6,331,151 B2
(45) **Date of Patent: *Dec. 18, 2001**

(54) PRESENTATION FOOTBALL CONSTRUCTION

(76) Inventor: Christopher John Calandro, 4524 Sarasota Dr., The Colony, TX (US) 75056

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/114,348

(22) Filed: Jul. 13, 1998

(51) Int. Cl.[7] ..... A63B 41/08
(52) U.S. Cl. ..... 473/599; 40/327
(58) Field of Search ..... 473/604, 599, 473/598, 603; 40/327

(56) References Cited

U.S. PATENT DOCUMENTS

| | | | | |
|---|---|---|---|---|
| 1,187,029 | * | 6/1916 | Beebout | 473/599 |
| 1,604,044 | | 10/1926 | Hart . | |
| 2,653,818 | | 9/1953 | Tebbetts, Jr. et al. . | |
| 3,091,562 | | 5/1963 | Berlepsch, Jr. et al. . | |
| 3,863,923 | | 2/1975 | Anderson . | |
| 4,093,219 | * | 6/1978 | Piraud | 473/599 |
| 4,337,944 | | 7/1982 | Massino . | |
| 5,320,345 | | 6/1994 | Lai et al. . | |
| 5,354,053 | | 10/1994 | Ratner et al. . | |
| 5,752,890 | * | 5/1998 | Shishido et al. | 473/604 |
| 5,779,578 | * | 7/1998 | Calandro | 473/604 |
| 5,896,230 | | 4/1999 | Goggins . | |

* cited by examiner

*Primary Examiner*—Jeanette Chapman
*Assistant Examiner*—M. Chambers
(74) *Attorney, Agent, or Firm*—Thompson & Gustavson, L.L.P.

(57) ABSTRACT

A presentation football (100, 200) is disclosed which includes a lenticular panel (102) or cloth panel (202) with art work thereon. One or more lenticular panels (102) or cloth panels (202) are adhesively secured to the football panels (12, 14, 16, 18) forming the football itself. The edges of the lenticular or cloth panel and football panels are sewn together with the football turned inside out. Once the sewing is completed, the football is turned inside out to form the football.

20 Claims, 3 Drawing Sheets

PRESENTATION FOOTBALL CONSTRUCTION

This invention relates to a novelty ball and, in particular, to the printing of artwork thereon.

BACKGROUND OF THE INVENTION

The market for novelty balls has been a growing one recently. The novelty ball usually has the shape and feel of a regulation ball. An important aspect of the novelty ball is the artwork presented thereon. A particular style of novelty ball may be sold in large quantities. For example, if the ball has a team logo thereon, a fan of that team would be the typical purchaser. However, a considerable market exists in the creation of novelty balls with innovative printing technologies. For example, full-motion video frames, three dimensional graphics and dynamic color animation may be now incorporated into a novelty ball.

Since the novelty ball is not normally purchased for competitive use, its essential reason for existence, the artwork thereon, is very critical to its marketability. A need exists for a method of printing and the resulting improved novelty ball which overcomes the shortcomings of prior designs, which includes lifting off of the artwork from the face of the ball, fading or discoloration of the artwork, and an initial inability in the first instance to print vibrant colors and dimensional and special effects imaging and printing technologies.

SUMMARY OF THE INVENTION

In accordance with one aspect of the present invention, a novelty ball is provided which includes a lenticular panel having artwork thereon and a plurality of ball panels to form the novelty football. In accordance with another aspect of the present invention, the lenticular panel is adhesively secured to one of the ball panels. In accordance with another aspect of the present invention, each of the lenticular and ball panels have internal edges, each of said ball panels being secured to the adjacent ball panels at abutting internal edges, the internal edges of the lenticular panel being secured to the internal edges of the ball panel to which it is adhered and also to the adjacent panel ball panels so that the edges of the lenticular panel are not exposed.

In accordance with another aspect of the present invention, a method of making a novelty ball is provided. The method includes the step of securing a lenticular panel or cloth panel to one or more ball panels. A plurality of ball panels are then secured together at their internal edges to form the ball.

BRIEF DESCRIPTION OF THE DRAWINGS

A more complete understanding of the invention and its advantages will be apparent from the following detailed description when taken in conjunction with the accompanying drawings in which.

DETAILED DESCRIPTION

Figure 2:
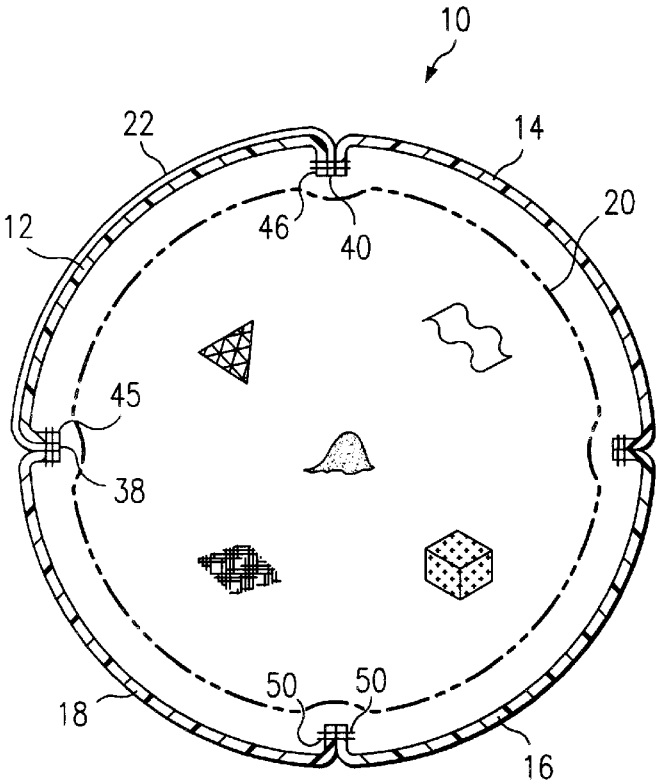
FIG. 2 is a cross section through then novelty ball illustrating the vinyl and ball panels secured together.

Referring now to the drawings, wherein like reference characters designate like or corresponding parts throughout the several views, and in particular to FIG. 2, there is illustrated a novelty ball 10 forming a first embodiment of the present invention. A novelty ball is generally not intended to ever be used in an actual ball game. Often, it is the same size as a regulation ball. However, it can be smaller or larger than a regulation ball. However it is generally constructed of materials and in a style similar to a regular ball.

As shown in FIG. 2, the novelty ball 10 is formed of four ball panels 12, 14, 16 and 18 sewn or otherwise secured together to form the traditional ball shape. A bladder 20 is provided within the cavity formed by the ball panels for inflating the ball to the desired pressure. The ball panel 12 has adhered to the exterior surface thereof a vinyl panel 22 which has artwork 24 on the exposed surface thereof The artwork may be a team logo, the name of a player, the score of an important ball game, photograph and the like. As will be described in greater detail hereafter, the artwork is printed on the final panel by a variety of color printers including, but not limited to, a resin printer 42.

Figure 1:
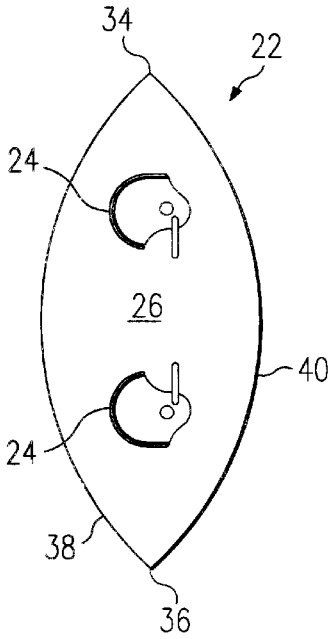
FIG. 1 is a plan view of vinyl panel with artwork thereon forming a portion of the novelty ball of the present invention.
Figure 3:
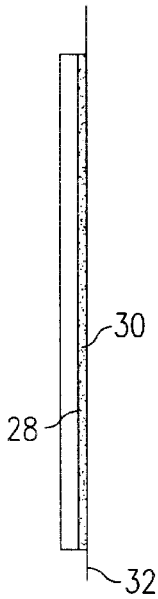
FIG. 3 is a side view of the vinyl panel illustrating the adhesive backing thereon.

With reference to FIG. 1 and FIG. 3, the vinyl panel 22 can be seen to be formed of a high performance vinyl that is flexible and can easily be stretched, preferably about 2 mils thick. The exposed side 26 of the vinyl panel 22 is receptive to artwork 24 printed thereon by a permanent color ink process such as a resin printer. The interior surface 28 has a layer of adhesive 30 formed thereon which adheres the vinyl panel 22 to ball panel 12. An adhesive backing sheet 32 protects and covers the adhesive 30 until the vinyl panel 22 is ready to be adhered to the ball panel 12. As is typical, the backing sheet 32 is made of a material to allow ready removal from the adhesive 30 when desired.

The vinyl panel 22 is cut from flat stock into the shape of the ball panels as illustrated in FIG. 1. The vinyl panel has ends 34 and 36 and curved side edges 38 and 40.

Figure 4:
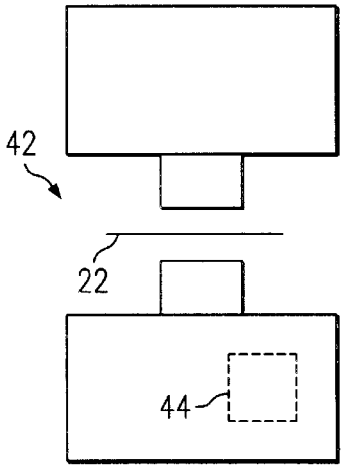
FIG. 4 is a side view of a printer utilized to print the artwork on the vinyl panel.

Before adherence to the ball panel 12, the artwork is printed on the vinyl panel 22 by a color ink process including, but not limited to, a resin printer 42. Water proof or water resistant outdoor durable inks are satisfactory. The artwork is designed on a template created in a computer 44. The computer 44 forms part of the resin printer 42, as seen in FIG. 4. Resin printers suitable for this operation are sold by Fargo Electronics of Eden Prairie, Minn. as Model 310S, Roland Digital Group of Irvine, California as Model ColorCAMM; Western Graphtec of Irvine, Calif. as Model GC1300, and Gerber Scientific Products of Manchester, Conn. as Model Edge.

After the artwork 24 is printed on the vinyl panel 22, the backing sheet 32 is removed and the vinyl panel is placed on the exterior surface of the ball panel 12, which itself is cut from a flat stock of suitable material, such as vinyl or leather, in the same basic shape and dimensions as the vinyl panel 22, and which has curved edges 45 and 46. A squeegee is preferably used to firmly apply the vinyl panel 22 on the ball panel 12 to remove any air bubbles and pockets between the two materials so that the vinyl panel is securely adhered to the ball panel 12 by the adhesive 30. While a resin printer is suggested, other suitable printers could be used.

With the vinyl panel 22 adhered to the ball panel 12, the ball panels 12–18 are formed into the novelty ball 10 itself. The curved edges of each of the panels are turned inwardly, as seen in FIG. 2, and secured to the inwardly turned edges of the adjacent panel by sewing with thread 50 or other securing techniques, such as gluing, clipping, heat bonding, and the like. The assembly of the ball is typically done inside out from the final shape as shown in FIG. 2 so that the edges are exposed to facilitate sewing or otherwise securing the edges together. One of the panels 12–18 will have a split therein and lacing as with a regular ball. The ball 10 is turned inside out through this split.

The edges 38 and 40 are sewed or otherwise secured between the edges 45 and 46 of ball panel 12 and the adjacent edges of ball panels 14 and 18 so that they are hidden from exterior the ball and also provide another mechanism to secure the vinyl panel on the ball panel 12 in addition to the adhesive. Also, the dimensions of the vinyl panel 22, if larger than the ball panel 12, may not be significant because any overlapping vinyl will ultimately be on the inside of the ball and unseen.

After the ball panels have been secured together, the ball is then turned right side out into the configuration as shown in FIG. 2. This is preferably done by hand to avoid tearing of the vinyl panel 22 and the artwork 24 thereon. However, it may be possible to design automated machinery to perform this function.

A bladder 20 is then placed within the ball through the split in one of the panels 12–18. The bladder has an air valve passing through a precut hole in one of the ball panels to allow the insertion of an inflation needle. The ball can then be laced and inflated to the desired pressure, typically 13 psi. It remains only then to package and ship the completed novelty ball 10 to the customer.

In addition to, or in substitution for, bladder 20, the ball can be filled with a filler. The filler can, for example, be sand, paper, cork, recycled material, material similar to that used in stuffed animals, a rigid core and the like. The filler material can be selected depending on cost and the application desired.

Mass personalization of display or novelty balls has never been successfully achieved before mainly because the technology would not allow for cost effective production. Silk-screening has been widely used in the past but is not feasible for small runs due to high set up costs. The present invention provides a process and apparatus allowing the printing of decorative balls with a permanent, premium quality impression. Advances in resin ink imprinting have aided this new process of printing novelty balls with exceptional quality. It has been found that the properties of the resin artwork does not adversely affect the ball manufacturing process. Even so, it has been found to be important that the balls are turned inside out manually. The printed image is durable and will withstand moisture and abrasion. Because of flexibility of resin print process and other permanent color printing processes, there are virtually no limits to what artwork can be created. In fact, the above process is truly a new ball manufacturing process and could be used to make regulation balls as well.

The process of the present invention can also be used to place panel images on a ball after the ball is made. The process can utilize a mold in the shape of an inflated ball panel which transfers images to the ball.

Figure 5:
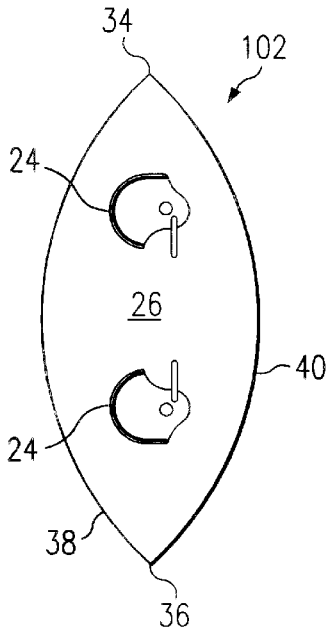
FIG. 5 is a plan view of a lenticular panel forming a portion of a first modification of the novelty ball of the present invention.
Figure 6:
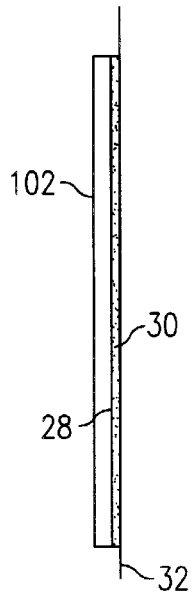
FIG. 6 is a side view of the lenticular panel illustrating the adhesive or bonding agent thereon.
Figure 7:
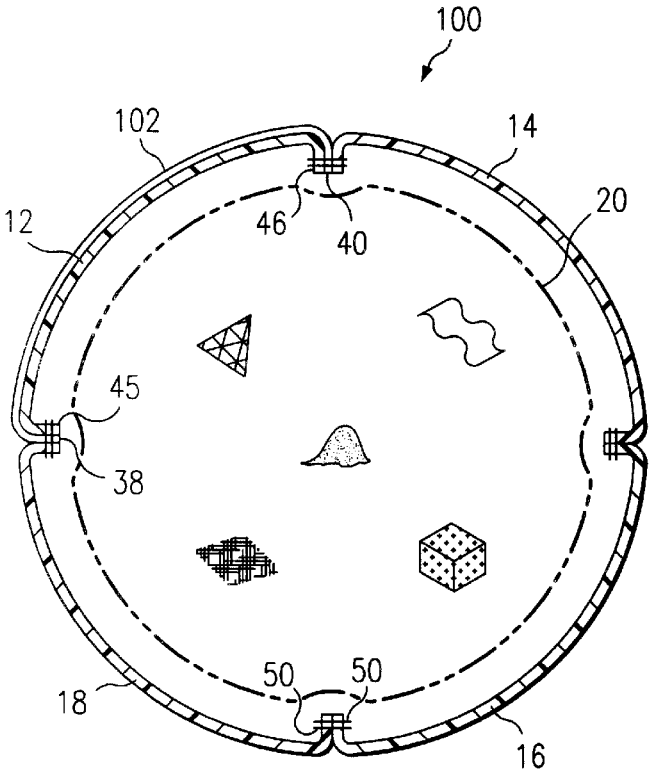
FIG. 7 is a cross section through the modified novelty ball illustrating the lenticular and panels secured together.

With reference now to FIGS. 5, 6 and 7 a modification of the novelty ball, illustrated as novelty ball 100, is illustrated. The novelty ball 100 is formed of four ball panels 12, 14, 16 and 18 just as novelty ball 10. However, rather than vinyl panel 22, a lenticular panel 102 is secured to the panel 12. As is well known, lenticular material reflects light to present a three-dimensional appearance. Lenticular material includes a base layer on which a composite image is formed. Depending on the complexity of the effect to be conveyed, the image is really a series of interlaced images, such as nine sequential images of a baseball player swinging a bat like the frames of a movie film. Each of the nine images is broken up into thin linear strips and placed on the base beside the other images which are similarly formed in thin linear strips. A precisely formed ribbed sheet, or lenticular sheet, is placed over the base on top of the image. The sheet has many optical grade cylindrical lenses extending linearly side by side. The sheet is placed over the image so that when the lenticular material is viewed from one angle, the cylindrical lenses magnify all the linear strips of a single one of the images. As the viewer's angle to the lenticular material changes, the cylindrical lens magnify other images in sequence. Thus, in the example of the baseball player's swing, by viewing the lenticular material across a arc of angles, the viewer sees all nine images in sequence to produce a visual effect of motion like watching a movie. The image can also be directly applied to the lenticular sheet, eliminating the need for the base. Because each eye of the viewer will view the image from a slightly different angle, the image seen by one eye will differ slightly from the image viewed by the other eye, giving rise to a three-dimensional effect. The use of the lenticular panel can thus provide an enhanced appearance to the ball. As with vinyl panel 22, a layer of adhesive 30 can be applied to the back of the lenticular panel 102 when the panel 102 is ready for application. In all other regards, the lenticular panel 102 can be used interchangeably with the vinyl panel 22, as desired. Lenticular graphics suitable for this operation are sold by Optigraphics, of Grand Prairie, Texas and Eastman Kodak Company as Dynamic Imaging Technology.

Figure 8:
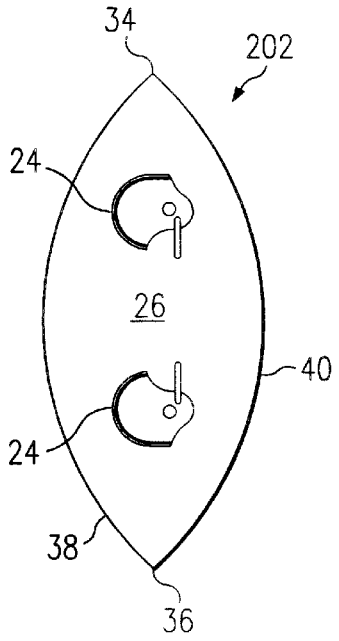
FIG. 8 is a plan view of a cloth panel forming a portion of a second modification of the novelty football of the present invention.
Figure 9:
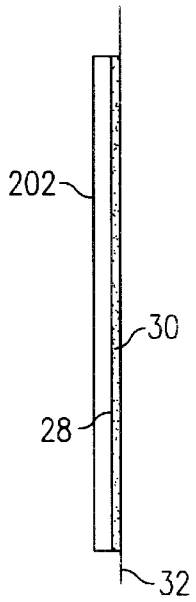
FIG. 9 is a side view of the cloth panel illustrating the adhesive or bonding agent thereon.
Figure 10:
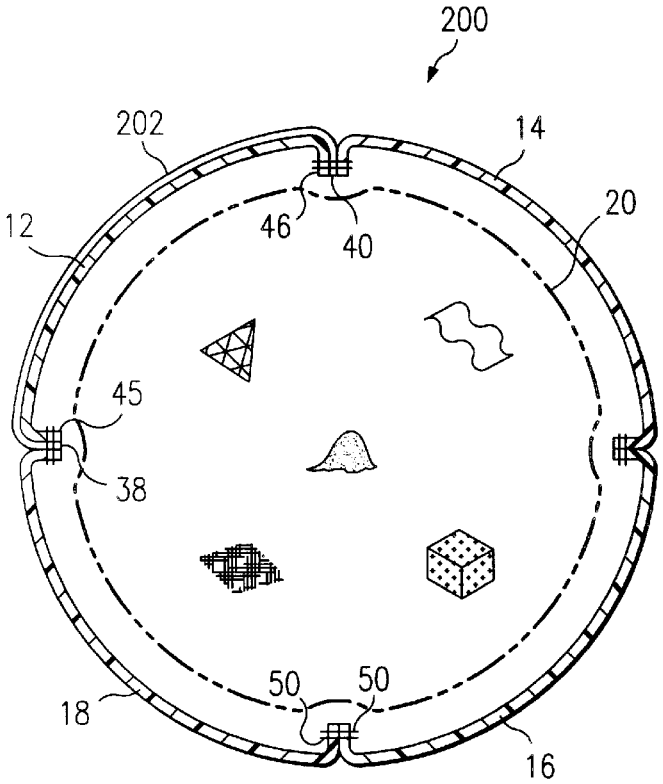
FIG. 10 is a cross section through the modified novelty ball illustrating the cloth and ball panels secured together.

With reference now to FIGS. 8,9 and 10 a modification of the novelty ball, illustrated as novelty football 200, is illustrated. The novelty ball is formed of four ball panels 12, 14, 16 and 18 just as novelty balls 10 and 100. However, rather than vinyl panel 22, or lenticular panel 102, a fabric or cloth panel 202 is secured to the panel 12. As is well known, fabric, particularly polyester and nylon, accepts sublimation inks and wax-thermal transfers very well. The use of the cloth panel allows dazzling, customized graphics to be applied both before and after the football has been assembled. As with vinyl panel 22, a layer of adhesive 30 can be applied to the back of the cloth panel 202 when the panel 202 is ready for application. In all other regards, the cloth panel 202 can be used interchangeably with the vinyl panel 22, or lenticular panel 102, as desired. Furthermore, many types of synthetic and natural textiles may be used, including, but not limited to, polyester, nylon, cotton, felt, satin, silk etc. or blends of these.

It will be understood that more than one vinyl panel 22, lenticular panel 102 or cloth panel 202 can be used on a given novelty ball by applying panels 22, 102 or 202 to football panels 14, 16 and 18. A given novelty ball can have a mix of panels 22, 102 and 202, if desired. In fact, all the ball panels 12, 14, 16 and 18 could have vinyl, lenticular or cloth panels adhered to them. In other words, the entire ball could be covered by vinyl, lenticular or cloth.

Although a single embodiment of the present invention has been illustrated in the accompanying drawings and described in the foregoing detailed description, it will be understood that the invention is not limited to the embodiment disclosed, but is capable of numerous rearrangements, modifications and substitutions of parts and elements without departing from the scope and spirit of the invention.

What is claimed is:

1. A novelty ball comprising:

at least one lenticular graphic panel reflecting light to present a three dimensional appearance;

a plurality of ball panels;

securing the lenticular panel to one of said ball panels; and the ball panels being secured together to form a ball.

2. The novelty ball of claim 1 wherein each of said panels has edges, the edges of each of said panels being secured to the edges of the adjacent panel.

3. The novelty ball of claim 2 wherein threads secure the panels together at their edges.

4. The novelty ball of claim 1 further including an air bladder to inflate the ball.

5. The novelty ball of claim 1 wherein the lenticular panel has dimensions similar to the dimensions of said ball panel to which it is secured, each of said panels having edges secured to the edges of adjacent panels, the edges of the lenticular panel and said one of the ball panels to which it is secured thereby being secured to the edges of adjacent ball panels.

6. The novelty ball of claim 1 wherein the ball is filled with a filler.

7. The novelty ball of claim 6 wherein the filler is selected from the group consisting of:

sand, paper, cork, recycled material and a rigid core.

8. A method for manufacturing a novelty ball, comprising the steps of:

forming at least one lenticular graphic panel reflecting light to present a three dimensional appearance;

securing the lenticular panel to one of a plurality of ball panels; and securing the panels together to from the ball, with the lenticular panel reflecting light to present a three dimensional appearance exposed on the exterior of the ball.

9. The method of claim 8 further comprising the step of securing the lenticular panel to the ball panel.

10. The method of claim 8 further comprising the steps of securing each of said ball panels to an adjacent ball panel at the edges thereof.

11. The method of claim 10 wherein the method further includes the step of securing the ball panels at the edges thereof with the edges exposed and then turning the panels inside out to form the ball.

12. The method of claim 8 further including the step of inserting an air bladder to inflate the novelty ball.

13. The method of claim 8 further comprising the step of filling the novelty ball with a filler.

14. The method of claim 13 wherein the step of filling the ball includes the step of filling the ball with filler selected from the group consisting of sand, cork, paper, recycled material and a rigid core.

15. The novelty ball of claim 1 wherein the ball panels are also lenticular panels.

16. The method of claim 8 wherein the ball panels are lenticular panels.

17. The method of claim 9 wherein the lenticular panel is secured to the ball panel with adhesive.

18. A novelty ball comprising:

at least one lenticular graphic panel reflecting light to present a three dimensional appearance;

a plurality of ball panels;

securing the lenticular graphic panel to one of said ball panels; and the panels being secured together to form a ball, the lenticular graphic panel on the exterior surface of the ball to reflect light to present a three dimensional appearance to an observer viewing the exterior surface of the ball.

19. The novelty ball of claim 18 wherein the plurality of ball panels are lenticular graphic panels.

20. The novelty ball of claim 18 wherein the novelty ball is a football, said at least one lenticular graphic panel having a peripheral edge, said plurality of ball panels being lenticular graphic panels having peripheral edges, said peripheral edges having a series of holes therein, the novelty ball further having thread passing through mating holes in adjacent panels to secure the panels together, the peripheral edges being turned inwardly away from the exterior surface of the novelty ball, each lenticular graphic panel having a base, an image formed on the base and a lenticular sheet having cylindrical lens formed therein.

* * * * *